United States Patent [19]

Tilton

[11] 4,127,101

[45] Nov. 28, 1978

[54] WINDOWED OVEN DOOR HAVING SHIELD RAISING AND DOOR LOCKING SYSTEM

[75] Inventor: Robert W. Tilton, Oakville, Canada

[73] Assignee: GSW Limited — GSW Limitee, Toronto, Canada

[21] Appl. No.: 799,538

[22] Filed: May 23, 1977

[51] Int. Cl.[2] ..... F23M 7/00

[52] U.S. Cl. ..... 126/200; 49/351; 49/353

[58] Field of Search ..... 126/200, 198; 49/350, 49/351, 353, 376; 219/396–398, 391, 392, 413, 414

[56] References Cited

U.S. PATENT DOCUMENTS

| | | | |
|---|---|---|---|
| 3,500,815 | 3/1970 | De Weese et al. | 126/200 |
| 3,717,138 | 2/1973 | Upp | 126/200 |
| 3,863,619 | 2/1975 | Wolf | 126/200 |
| 4,022,183 | 5/1977 | Martin | 126/200 |

*Primary Examiner*—John J. Camby
*Assistant Examiner*—Larry I. Schwartz

[57] ABSTRACT

A windowed oven door for ranges having self-cleaning ovens comprises a system for simultaneously locking the door and raising a shield to cover the window. A linkage mechanism in the shield raising part of the system includes a pair of overcenter link arms which are retained in their past dead center position while the oven door is locked on an oven during its self-cleaning cycle.

29 Claims, 7 Drawing Figures

WINDOWED OVEN DOOR HAVING SHIELD RAISING AND DOOR LOCKING SYSTEM

FIELD OF THE INVENTION

This invention relates to ovens and more particularly to windowed oven doors for self-cleaning ovens of ranges and the like.

BACKGROUND OF THE INVENTION

It is customary to provide a window in an oven door so that baking, broiling and other cooking operations within an oven can be observed. Ranges equipped with an oven self-cleaning cycle raise the temperature of the oven to temperatures which cause pyrolysis of built-up grease and grime. This results in raising the external temperatures of the oven door, and in particular the oven window, to hazardous levels. Provisions are therefore made to heavily insulate the standard oven door plug, to improve on cooling ventilation of the door and to protect with a shield the outer transparent pane in the window from thermal radiation generated in the oven operating at the higher self-cleaning temperatures. Due to this vast range of temperatures at which the oven operates, the design of the mechanism for raising and lowering the shield to and from a window covering position has to accommodate thermal expansion therein. Some mechanisms involve very complex linkage systems for raising and lowering the shield and track systems for the shield which from time to time become stuck in their operation and are usually noisy in operation. It is important to provide a lock means on the oven door to lock the oven door shut to preclude user injury while the oven is operating at the higher self-cleaning temperatures. Mechanisms are available on oven doors which raise a shield to a window covering position and lock the oven door shut on an oven. However, such mechanisms are usually complex in nature and are expensive to manufacture.

This invention provides in a windowed oven door a system which locks an oven door shut on an oven while raising a shield within the door to a window covering position in an effortless manner involving a small number of parts with the resultant reduction in manufacturing costs.

BRIEF SUMMARY OF THE INVENTION

A windowed oven door according to this invention for an oven has inner and outer door panels with aligned window openings, at least one transparent pane being positioned in each window opening. A rotatable member is mounted in the door above the window openings, the rotation of which is common to the movement of locking the oven door shut on an oven and the movement of raising and lowering the shield to a window covering position. The mechanism for raising and lowering the shield includes a linkage system where rotation of the rotatable member is translated by the linkage system into raising or lowering the shield to or from a position which blocks the window openings. The linkage system includes first and second link arms which are pivotally connected together and which are adapted to extend during the linkage system's movement for raising the shield. The first and second link arms attain a dead center position when at their maximum extension and the shield is at its maximum height in the door. An overcenter stop means is provided for stopping movement of the first and second link arms as they pass their dead center position. The overcenter stop means operates to prevent continued downward descent of the shield so that the shield is maintained in a position to block the window openings and to shield the outer transparent window pane from thermal radiation generated by an oven.

The first and second link arms of the linkage mechanism may be arranged so as to always be above the window in the oven door. The first link arm according to an embodiment of the invention has an end secured to said rotatable member and adapted to move through a vertical plane upon rotation of said rotatable member. The free end of the first link arm being pivotally connected to the second link arm and arranged so that the first and second link arms extend in the desired manner during locking of the oven door to raise the shield to a window covering position.

A guidance means for guiding the movement of the shield may be provided to further reduce noise in the shield raising operation. The shield ends are overturned to provide two channels through which rods extend. The rods are mounted in the door on each side of the window opening. The rods may be covered with a friction reducing material to further dampen noise generated by the shield movement. The overlapped ends of the shield provide a simple arrangement for engagement between the rods and shield.

The rotation of the rotatable member is coordinated with the motion of locking the oven door shut. Various types of locking means may be used where, for example, the rotation of the rotatable member effects locking of the door or movement of the locking means effects the desired rotation of the rotatable member.

DESCRIPTION OF THE DRAWINGS

These and other objects, advantages and features of the invention will become apparent in the following detailed description of the preferred embodiments of the invention, as shown in the drawings wherein.

DETAILED DESCRIPTION OF THE PREFERRED EMBODIMENTS OF THE INVENTION

Figure 1:
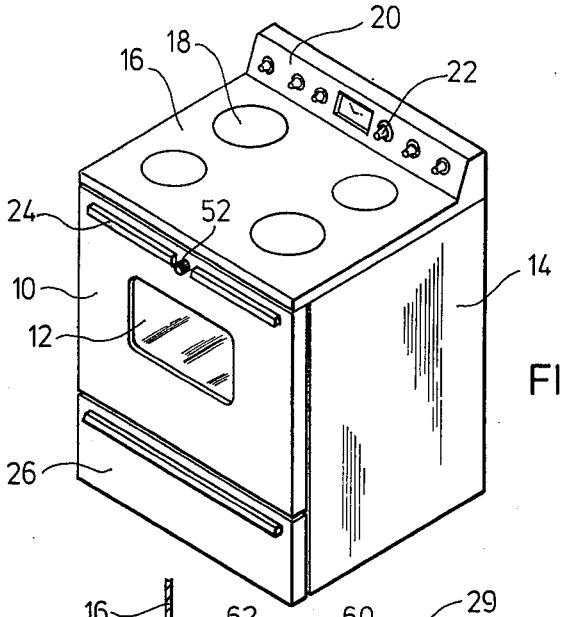
FIG. 1 is an isometric view of an oven having a windowed oven door.

The range as shown in FIG. 1 has a windowed oven door 10 with window opening 12. The door is mounted on an oven frame 14 having a cooking top 16 with burner elements 18. A control panel 20 is provided with control knobs 22 for controlling functions of the various burner elements 18, the oven temperatures and the oven self-cleaning cycle. The oven door 10 has a handle 24 to facilitate its opening and closing. A conventional pots and pans drawer 26 is provided at the base of the range.

Figure 2:
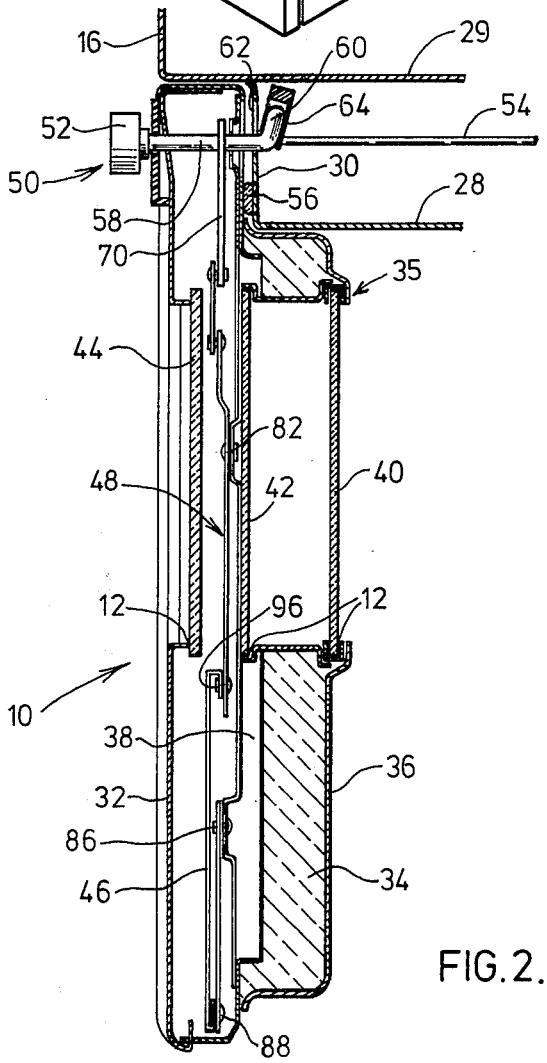
FIG. 2 is a sectional view of the windowed oven door and a portion of the oven frame according to this invention.

Turning to the section of the oven door shown in FIG. 2 with the door in the oven closing position, the upper part of the oven door 10 is beneath the cooking top 16. The oven frame has a liner portion 28 which defines the oven cavity and a vertical face plate portion 30 at its front. The oven door 10 has an outer panel 32 and an inner panel 38. Each has a window opening 12. The inner panel 38 has a further panel 36 spaced therefrom and mounted thereto to form the plug portion 35 of the oven door which projects within the oven cavity.

The plug portion is well insulated with fire-proof insulation 34. Panel 36 also has a window opening 12 aligned with the others. The window openings have transparent panes 40, 42, and 44. Spaced apart panes 40 and 42 form an insulative barrier in the plug portion. A shield 46 is located in its lowered position beneath window opening 12 between the inner and outer door panels. A linkage mechanism generally designated at 48 is mounted within the door and is capable of raising and lowering the shield to and from a position which blocks the window opening 12 and shields the outer transparent pane 44 from thermal radiation generated within the oven operating at self-cleaning temperatures.

A lock mechanism generally designated 50 is provided in the upper part of the door 10 and in this particular instance is actuated by an external grasp or knob 52. The lock mechanism 50 in this preferred embodiment has a lug portion 60 upstanding from its rotatable shaft 58. The lug portion 60 is received by a slot 62 in plate 30 of the oven frame. Rotation of knob 52 places the lug 60 in a position offset from the slot 62 to lock the door shut by engagement of lug 60 with the inner surface of plate 30. Rod 54 has at its end a cup portion 64 which snugly receives lug 60 to cause rotation in rod 54. At the back of the range, switches are located and are actuated by rod rotation. Such switches when actuated serve to start the self-cleaning cycle if the controls are properly set and activate a stop to the rotation of rod 54 in an unlocking direction before lug 60 is aligned with slot 62 while the oven is operating at self-cleaning temperatures. This prevents the user from unlocking the oven door and opening the oven when at temperatures in excess of about 500° F. A gasket 56 is provided on the inner part of the door to reduce heat losses from the oven.

Figure 3:
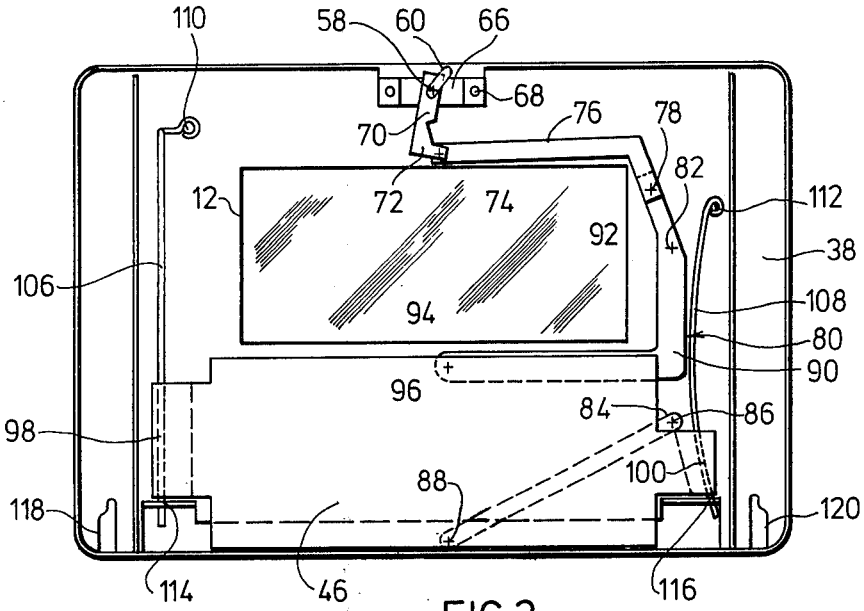
FIG. 3 is a view of the oven door with the front panel removed to show the mechanism for raising and lowering the shield, the shield being in its lowered position.
Figure 4:
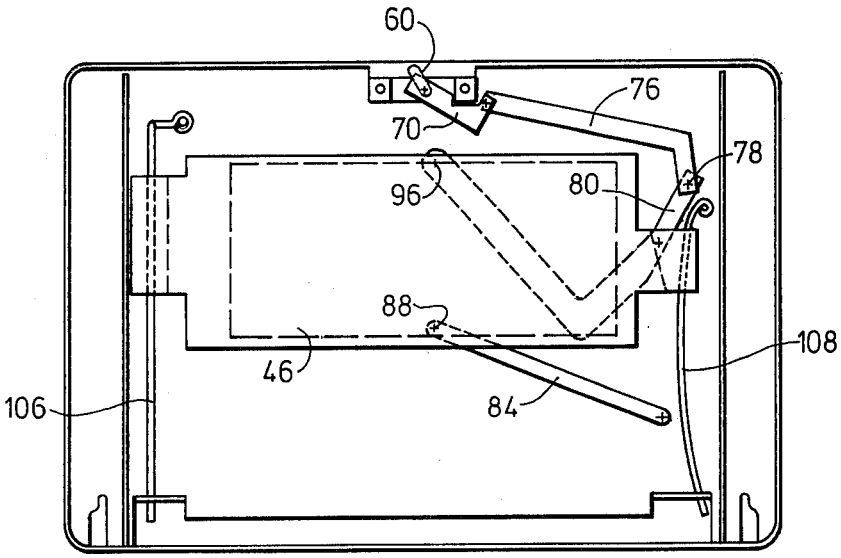
FIG. 4 is a view of the door panel of FIG. 3 with the shield in the raised position.
Figure 5:
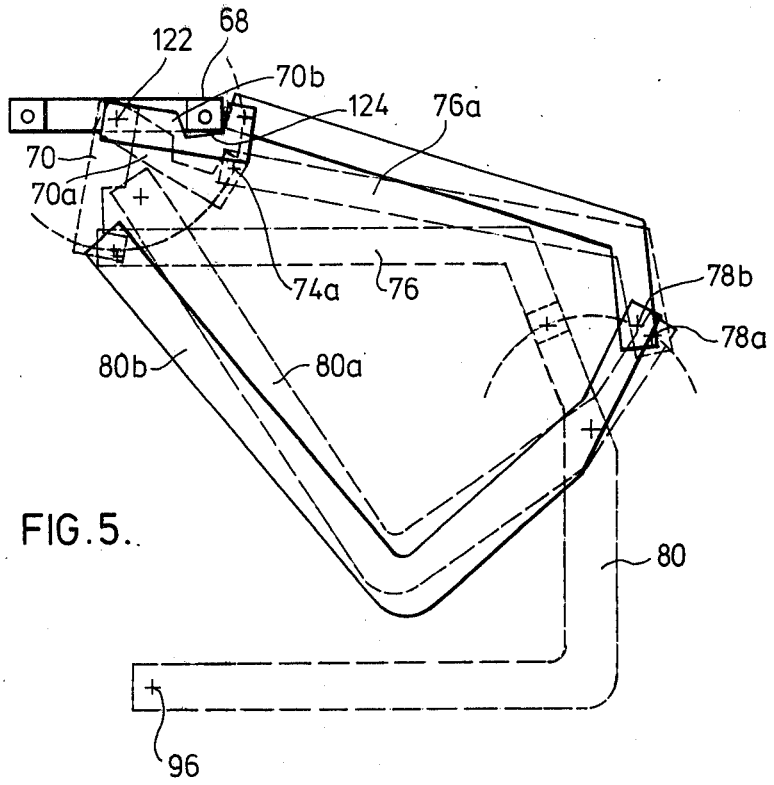
FIG. 5 is a view of various positions of parts of the linkage mechanism during the raising of a shield.

FIGS. 3, 4 and 5 show various positions of the linkage mechanism in its raising and lowering the shield within the oven door and the movement of the linkage mechanism when the shield is at its uppermost and just past dead center positions. The inner panel 38 is shown in FIG. 3 where in this embodiment, the linkage mechanism is mounted on such panel. The rotatable member 58 with the lug portion 60 is mounted in a frame 66 which is in turn fastened to the inner panel by spotwelds 68. Secured to the rotatable member 58 is a first link or arm 70 which as shown in FIGS. 2 and 3 extends radially downwardly from the rotatable member and swings through a vertical plane with the door in the vertical position. The free end 72 of the arm 70 is pivotally connected at 74 to a link arm 76. Both these arms are located above the window opening 12 and may be referred to as first and second link arms. Link arm 76 extends somewhat transversely of the oven door above the window. The other end of link arm 76 is pivotally connected at 78 to the device which in turn is connected to and thereby raises and lowers the shield. In this embodiment of the invention, the device comprises an L-shaped link arm 80 which is pivotally mounted to the inner panel 38 at 82 in the manner shown in FIG. 2.

It is understood that some form of guidance means for shield movement is necessary with this particular embodiment because of the single pivotal connection of the L-shaped arm to the shield at 96. However, with other types of linkages, a guidance system may not be necessary or the guidance aspect may be inherent in the arrangement of the linkage system. As part of the means for guiding shield movement in this embodiment a third or guide link arm 84 is provided. At one end it is pivotally mounted at 86 on the inner door panel. The other end is pivotally connected at 88 to the lower portion of shield 46. L-shaped link arm 80 has a first arm 90 extending upwardly and to a side of the window opening 12 with an inwardly bent portion 92. The second leg 94 of L-shaped arm 80 extends beneath window opening 12 and is pivotally connected to the shield at 96. To ensure a smooth raising of the shield and a swinging arc to its motion, pivot point pair 82, 86 and pair 88, 96 are vertically aligned and are always maintained in parallelogram relationship during the raising and lowering of the shield.

Figure 6:
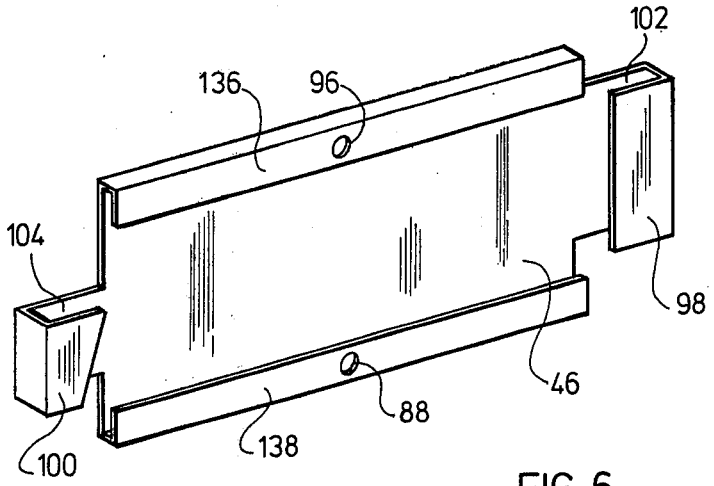
FIG. 6 is a view of the shield.

To improve on the smoothness in raising and lowering of the shield in a noiseless manner while the door is in a vertical position, the guidance system also includes a track means. The shield has overturned ends 98 and 100 to form channels 102 and 104 which are more clearly shown in FIG. 6. Rods 106 and 108 are secured at their upper extremities at 110 and 112 and at their lower extremities by location in tabs at 114 and 116. The rods 106 and 108 extend through channels 102 and 104 respectively. Due to the parallelogram relationship of the corresponding pivot points of arms 84 and 80, the shield 46 is swung upwardly along an arcuate path as apparent from comparism of shield positions in FIGS. 3 and 4. To accommodate this swinging motion, rod 108 is shaped so as to not bind against the bottom of overturned end 100. Rod 106 is straight because overlapped end 98 of shield 46 is moving away from the rod. However, it is important to ensure that the degree of overlap of portion 98 be sufficient to maintain engagement of the rod within overturned end 98 during the upward and downward movement of the shield. The upper and lower portions of shield are overturned to provide lips 136 and 138 to which the link arms 80 and 84 are pivotally connected at points 96 and 88. These pivot points are behind the shield so that the points of connection are invisible to provide a pleasing appearance from the oven door front.

Rods 106 and 108 may be coated with a friction reducing material to facilitate the shield's quiet sliding over the rods. Apertures 118 and 120 are provided on both sides at the bottom of the inner panel 38 to accommodate hinge arms which locate the door on the oven frame.

FIG. 4 illustrates the shield 46 in its window covering position with the link arms in a new position where the lug 60 is rotated about the axis of the rotatable member 58 counterclockwise approximately 90° and is therefore out of alignment with the slot in the oven frame to ensure the locking of the door shut on the oven. In moving the locking mechanism 50 to lock the door shut, the first arm 70 as it is secured to the rotatable member 58 is also swung counterclockwise. Due to its pivotal relationship with the second link arm 76 and the second link arms pivotal relationship with the L-shaped arm, arms 70 and 76 extend resulting in a transverse motion of pivot point 78 away from the axis of rotation of member 58. This causes the L-shaped arm to pivot about point 82 in a clockwise direction thereby raising the shield to a window covering position. The geometry of the link arms is such to translate the approximate 90° rotation of the locking mechanism into a sufficient movement in the linkage system to raise the shield to a window covering position.

Turning to FIG. 5, as the first and second link arms 70 and 76 extend, they reach maximum extension in positions 70*a* and 76*a*. At this point, the axis of rotation 122 of rotatable member 58, the pivot point 74*a* and pivot point 78*a* are aligned and the distance between axis 122 and pivot point 78*a* is at a maximum. This position of the first and second link arms is therefore referred to as the dead center position. It is apparent that with the first and second link arms in the dead centre position the shield 46 is at its maximum height within the door.

The rotation of the rotatable member 58 is continued until first link arm 70 attains position 70*b* where its recessed portion 124 meets frame 68 to interfere with its continued movement and thereby constitute an overcentre stop means. However, with this rotation past dead centre of the first and second link arms, they retract from their maximum extension the distance between pivot point 78*b* and axis 122 decreasing. This results in a slight lowering of the shield, the L-shaped arm moving to position 80*b*. The stop or interference between recess 124 and frame member 68 is so arranged that the downward movement of the shield does not drop far enough to uncover any portion of the window. Due to this overcentre stop of the first and second link arms, the weight of the shield maintains the interference between 124 and 68. With this overcentre locking of the shield in the raised position, there is a positive snap action in the rotation of the rotatable member 58 to indicate to the user that the shield is in its proper window covering position. Therefore, with the oven door in the lock position, the shield 46 is retained in a window covering position by the overcentre stop arrangement so that the range is now ready for the oven self-cleaning cycle.

It is appreciated that other forms of stop means may be employed in providing the overcentre stop for link arms 70 and 76. Such stop means may include a tab struck from either first or second link arms 70, 76, which interferes with the continued movement of either arm at a position which would be equivalent to the interference between frame 68 and recessed part 124 or arm 70. It is also apparent that pins or the like may be substituted for the frame part 68 to constitute a stop or interference with the continued motion of the first and second link arms past the dead centre position.

As discussed, the rotatable member 58 is common to both the motion of locking the oven door and raising the shield. It is apparent that other forms of locking mechanisms may be employed which on movement to the locking position effect rotation in rotatable member 58 to cause a raising of the shield.

Figure 7:
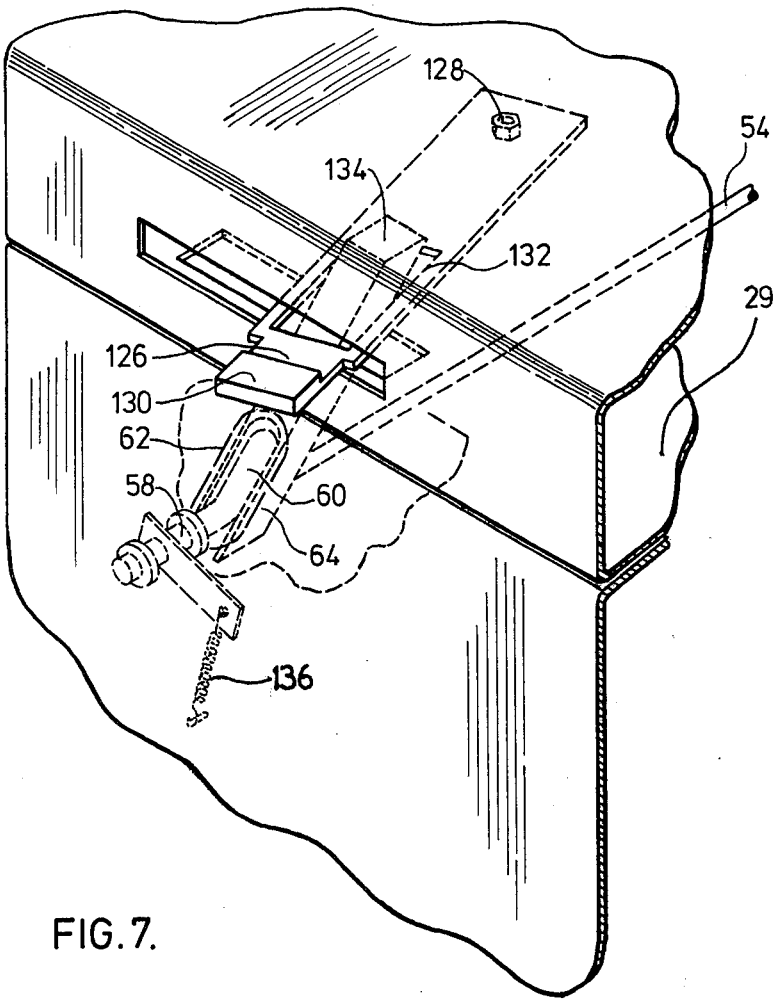
FIG. 7 is a view of a section of oven door and range body to show an alternative lock actuation means which is mounted on the oven frame.

An alternative form of lock actuation means is illustrated in FIG. 7 where a rotatable arm 126 is mounted on the oven frame upper portion 29 and is pivoted about connection 128 by grasping knob 130. The arm 126 is provided with a rectangular slot 132 through which an extension 134 secured to cup 64 extends. A return spring 136 is provided to maintain lug 60 in position for registration with slot 62 when the oven door is closed. It is apparent that moving the arm 126 in a clockwise direction about point 128 causes rotation of the extension 134 about rotatable arm 58 in a counterclockwise direction to effect desired locking of the oven door shut on an oven and at the same time effects the desired rotation of rotatable member 58 to raise the shield to the window covering position.

Other arrangements are possible, such as providing the rotatable member 58 with an upstanding member internally of the door which is engaged by a locking member provided on the oven frame such that the locking members movement across the length of the door causes the desired rotation in the rotatable member while at the same time effecting a secure locking of the door on the oven.

After the self-cleaning cycle has been completed and the oven has cooled down below approximately 500° F., the aforementioned switches release the stop on rod 54 to permit rotation of the locking means 50 in a direction to unlock the door. It is understood that in carrying out the unlocking procedure, the linkage mechanism initially raises the shield until the first and second link arms reach their dead centre position and then begins lowering the shield as the first and second link arms pass their dead centre position and resume positions 70 and 76.

As can be appreciated by those skilled in the art, this arrangement of linkage system with the overcentre stop entails the use of a small number of parts thereby reducing manufacturing costs in providing a mechanism for raising and lowering the shield. Guidance means in the form of a secondary link arm 84 and guide rods 106 and 108 to which the shield is mounted provide for an improved noiseless operation.

Although various preferred embodiments of the invention have been described herein in detail, it will be understood by those skilled in the art that variations may be made thereto in providing an operative unit which fall within the spirit of the invention and the scope of the appended claims.

The embodiments of the invention in which an exclusive property or privilege is claimed are defined as follows:

1. In an oven door having spaced apart inner and outer door panels with aligned window openings and at least one transparent pane in each window opening, a linkage system for raising and lowering a shield positioned between said door panels, a rotatable member mounted in said door above the window openings, said rotatable member being rotated during locking of the door shut on an oven, said linkage system being connected to said rotatable member whereby such rotational movement of said rotatable member is translated by said linkage system into raising said shield to a position which covers such pane in the outer door panel, said linkage system including first and second link arms which are pivotally connected together and which extend as said shield is raised during the rotational movement of said rotatable member; said first and second link arms attaining a dead centre position when they are at their maximum extension and said shield is raised to its maximum height in the door, an over-centre stop means for stopping movement of said first and second link arms as they pass their dead centre position thereby preventing continued downward descent of said shield so that the shield is maintained in a window covering position while the door is locked.

2. In an oven door of claim 1, rotation of said rotatable member co-operating with a locking movement in a lock means to lock said door shut on an oven, such locking movement being activated by an externally operable grasp.

3. In an oven door of claim 1, said rotatable member having a locking portion extending outwardly of said inner door panel and a manually operable grasp extending outwardly of said outer door panel, said locking portion being adapted to engage an oven frame and lock said oven door shut on an oven upon rotation of said rotatable member.

4. In an oven door of claim 2 the unconnected end of said first link arm being secured to said rotatable means.

5. In an oven door of claim 4, a L-shaped link arm being pivotally mounted in said door to a side of said window openings, a first leg of which has its end pivotally connected to said second link arm and a second leg of which has its end pivotally connected to said shield, said first leg extending upwardly of said door and said second leg extending across said door, and guide means for guiding movement of said shield within said door.

6. In an oven door of claim 5, said guide means comprising a guide link arm connected to said shield and mounted in said door beneath said L-shaped arm where its pivot points at each end in conjunction with the respective pivot points of said L-shaped link arm define a parallelogram.

7. In an oven door of claim 6, a track system on which said shield is mounted comprising first and second rods extending vertically of said door located on each side of the window, each end of said shield having overturned edges to define channels through which said first and second rods extend, the overturned edges overlapping said shield sufficiently to preclude disengagement of the shield from the rods as it is raised and lowered.

8. In an oven door of claim 4, said stop means being positioned within said door to block further movement of said first link arm after it passes through the dead centre position.

9. In an oven door of claim 8, a frame member in which said rotatable member is mounted having a portion thereof to one side constituting said stop portion.

10. In a self-cleaning oven with a windowed oven door, said door including transparent window panes in its outer and inner door panels, a shield located within the door for blocking said window panes and shielding the outer transparent pane from thermal radiation generated by said oven operating at self-cleaning temperatures, a system to which said shield is mounted being capable of raising and lowering the shield to and from a window covering position, said system comprising a rotatable member mounted in said door above said window openings, the rotation of said rotatable member being co-ordinated with a movement which causes locking of the door shut on said oven, a first link arm secured to said rotatable member and positioned for movement through a vertical plane during rotation of said rotatable member, a second link arm having one end pivotally connected to a free end of said first link arm and the other end pivotally connected to an end of an L-shaped link arm, said L-shaped link arm being pivotally mounted to one side of said window within said door, the other end of said L-shaped link arm being pivotally connected to said shield, guide means for guiding movement of said shield, the arrangement being such that rotational movement of said rotatable member is translated into raising said shield to a window covering position, said first link arm and said second link arm being at their maximum extension when the axis of rotation of said rotatable member, the pivot point between said first and second link arms and the pivot point between said second and L-shaped link arms are aligned, a stop means for interfering with continued movement of said first and second link arms to stop rotation of said rotatable member after maximum extension of said first and second link arms, the weight of said shield maintaining the interference with the movement of said first and second link arms to thereby retain said shield in the window covering position.

11. In an oven of claim 10, said first and second link arms being located above said window at all times during shield raising, said L-shaped arm having a first leg which is connected to said second link arm, extending upwardly of said door alongside the window, a second leg of said L-shaped arm which is connected to said shield extending across said door beneath said window when the shield is in its lowered position, said second leg being pivotally connected to the top portion of the shield.

12. In an oven of claim 10, said guide means being a third link arm located below said L-shaped arm and having one end pivotally connected to said shield and the other end pivotally mounted in said door with the pivot points of said third arm and corresponding pivot points of said L-shaped arm defining a parallelogram.

13. In an oven of claim 10, lock actuation means mounted on the oven frame above said door, movement of said lock actuation means to a door locking position rotating said rotatable member by an interengagement between said lock actuation means and said rotatable member.

14. In an oven of claim 13, said rotatable member having a lug extending outwardly of said inner door panel, said lug being received internally of said oven frame through a slot provided therein, said lock actuation means having a portion engaging said lug for rotation thereof upon movement of said lock actuation means to a door locking position.

15. In an oven of claim 14, a handle mounted on said lock actuation means and being external of said oven and above said door.

16. In an oven of claim 10, said rotatable member comprising a lug portion extending outwardly of said inner door panel, said lug portion being adapted to engage the oven frame in a manner to lock the door shut on said oven when said rotatable member is rotated in the proper direction.

17. In an oven of claim 13, said rotatable member having connected thereto an externally accessible grasp on said outer door panel.

18. In an oven door having spaced apart outer and inner door panels with aligned window openings and at least one transparent window pane in each window opening, apparatus for holding said oven door at and releasing said oven door from a closed locked position on an oven and for raising and lowering a shield between said door panels to and from a position which covers and shields such transparent window pane in said outer door panel from thermal radiation generated by an oven operating at high temperatures, said apparatus comprising rotatable means mounted in said door panels above said window openings, said rotatable means having an oven frame engaging portion extending outwardly from the inner door panel which is adapted to engage and hold said oven door closed upon rotation of said rotatable means to a door locked position, said rotatable means having an arm extending outwardly from said rotatable means between said door panels, said arm having its free end pivotally connected to a first end of a link arm extending transversely of the door above said window opening, a second end of said link arm being pivotally connected to a device for raising and lowering said shield, the position of said arm in a door unlocked position being such that upon rotation of said rotatable means to a door locked position, said arm and link arm are extended to and retracted from maximum extension in a direction transverse of said door where such transverse movement is translated into raising and lowering said shield by said device, a stop means for stopping rotation of said rotatable means at a point where said arm and link arm are retracting from maximum extension by continued door locking rotation, said shield in its attempting to continue its downward movement maintains operability of said stop means to hold said shield in the window covering position while the oven door is locked shut on an oven.

19. In an oven door of claim 18, said device comprises an L-shaped arm pivotally mounted on the inner panel of said door to one side of said window opening, a first arm of said L-shaped arm extending upwardly alongside the window opening and having its upper end pivotally connected to said link arm, a second arm of said L-shaped arm extending transversely of said door beneath said window when said shield is in its lowered position, the end of said second arm being pivotally connected to the upper portion of said shield, the transverse movement of said link arm pivoting said L-shaped arm to either raise or lower the shield depending upon the direction of rotation of said rotatable means, and guide means provided to guide the movement of said shield.

20. In an oven door of claim 19, said guide means comprising a second link arm pivotally connected to said shield at one end and at the other end pivotally mounted on said inner door panel, the respective pivot points of said L-shaped arm and second link arm being in parallelogram relationship.

21. In an oven door of claim 18, said rotatable means being mounted in a frame secured to said inner door panel, a portion of said frame constituting said stop means which is contacted by said arm.

22. An oven door comprising spaced apart outer and inner door panels with aligned window openings and at least one transparent window pane in each window opening, a shield positioned between said outer and inner door panels and mounted on a transport mechanism for raising and lowering said shield to and from a position which covers and shields such transparent window pane in said outer door panel from thermal radiation generated by an oven, and rotatable means for locking said oven door shut which upon rotation to a locking position activates said transport mechanism to raise said shield to the window covering position, said rotatable means being mounted in said door panels above said window openings and having a lock portion extending outwardly from said inner panel and an arm extending radially from said rotatable means between said door panels and always remaining above said window openings, said lock portion being adapted to engage a mating lock portion on an oven frame to lock said oven door shut upon rotation of said rotatable means, said arm being pivotally connected to an end of a link arm which extends transversely of said oven door between said door panels and always above said window openings, the other end of said link arm being pivotally connected to a part of said transport means, the arrangement of said arm relative to said link arm being such that as said rotatable means is rotated to lock said oven door shut, the distance between the pivot point at said other end of said link arm and the axis of rotation of said rotatable means increases and decreases from a maximum with corresponding transverse movement of said link arm, such transverse movement being translated into raising said shield by virtue of said link arm's connection with a part of said transport mechanism where said shield is raised to its maximum vertical height when the oven door is closed on an oven as said distance attains a maximum, stop means for stopping rotation of said rotatable means at a position after said maximum distance has been attained and passed in the direction of rotation to the locking position, the stop means being positioned to locate said shield over such window pane and thereby retain said shield in the window covering position.

23. An oven door of claim 22, said lock portion being a lug which is adapted to engage an oven frame member to lock said oven door shut during rotation of said rotatable member.

24. An oven door of claim 22, said transport means comprising an L-shaped arm, a second link arm, and guide means for guiding movement of said shield, said L-shaped arm being pivotally mounted to the inner door panel and to one side of said window openings, a first arm of said L-shaped arm extending upwardly alongside said window opening with its end pivotally connected to said link arm, a second arm of said L-shaped arm extending across said oven door beneath said window when the shield is in its lowered position, its end being pivotally connected to said shield, said second link arm having one end pivotally connected to said shield beneath said second arm and having its other end pivotally mounted to said inner door panel, the pivot points of said second arm and second link arm being vertically aligned.

25. An oven door of claim 24, wherein said guide means comprises two rods extending upwardly in said door and positioned to each side of said window openings, each end of said shield having overturned edges which engage said rods, the rod located on the side of the window on which said L-shaped arm is pivoted being shaped to accommodate the swinging movement of said shield as it is raised, the other rod being straight where the overturned edge of the shield sufficiently overlaps the rod to ensure continuous engagement therewith.

26. An oven door of claim 25, wherein said rods are covered with a friction reducing material.

27. An oven door of claim 24, wherein the top and bottom portions of the shield are overturned to provide points of connection to the shield which are invisible from the front of the door.

28. In an oven door, having spaced apart outer and inner door panels with aligned window openings and one or more transparent window panes, an apparatus for raising and lowering a shield to and from a position which covers and shields such transparent window pane in said outer panel from thermal radiation generated by an oven, locking means which co-operates with an oven frame for locking said oven door shut on an oven, and guide means for guiding movement of said shield within said door, said apparatus being capable of swinging said shield upwardly along an arcuate path to move said shield to a window covering position, said guide means comprising a rod positioned on each side of said window, the ends of said shield being overturned to define a channel at each shield end through which said rods extend, the degree to which said ends are overturned being sufficient to ensure engagement of said shield with said rods at all times during its swinging movement, said rods being covered with a friction reducing material.

29. In an oven door of claim 28, at least one of said rods being shaped to accommodate the arcuate swinging movement of said shield.

* * * * *